US009986759B2

(12) United States Patent
Besso

(10) Patent No.: US 9,986,759 B2
(45) Date of Patent: Jun. 5, 2018

(54) SMOKING ARTICLE WITH LIQUID DELIVERY MATERIAL

(71) Applicant: PHILIP MORRIS PRODUCTS S.A., Neuchatel (CH)

(72) Inventor: Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 980 days.

(21) Appl. No.: 14/356,441

(22) PCT Filed: Nov. 2, 2012

(86) PCT No.: PCT/EP2012/071768
§ 371 (c)(1),
(2) Date: May 6, 2014

(87) PCT Pub. No.: WO2013/068304
PCT Pub. Date: May 16, 2013

(65) Prior Publication Data

US 2014/0360518 A1 Dec. 11, 2014

(30) Foreign Application Priority Data

Nov. 7, 2011 (EP) ..... 11250885

(51) Int. Cl.
*A24D 3/06* (2006.01)
*A24D 3/04* (2006.01)
*A24D 1/00* (2006.01)

(52) U.S. Cl.
CPC ..... *A24D 3/066* (2013.01); *A24D 1/002* (2013.01); *A24D 3/048* (2013.01); *A24D 3/061* (2013.01)

(58) Field of Classification Search
USPC ..... 131/274, 331, 3, 32, 343, 344, 360–36
See application file for complete search history.

(56) References Cited

U.S. PATENT DOCUMENTS 3,366,121 A 1/1968 Carty
3,390,686 A * 7/1968 Irby, Jr. ..... A24D 3/061 131/337

(Continued)

FOREIGN PATENT DOCUMENTS

CN 1747663 3/2006
CN 101193564 6/2008

(Continued)

OTHER PUBLICATIONS

Definition of "sustained", Cambridge Academic Content Dictionary, No Date, [online}, retrieved from the Internet,[retrieved Jun. 20, 2017],<URL:http://dictionary.cambridge.org/us/dictionary/english/sustained>.*

(Continued)

*Primary Examiner* — Dennis R Cordray
(74) *Attorney, Agent, or Firm* — Mueting, Raasch & Gebhardt, P.A.

(57) ABSTRACT

A smoking article (10) incorporates a sustained release liquid delivery material (20), the liquid delivery material comprising a closed matrix structure defining a plurality of domains. A liquid composition is trapped within the domains and is releasable from the closed matrix structure upon compression of the material. The liquid delivery material (20) provides a sustained release of the liquid composition over a range of force of at least 5 Newtons. Preferably, the liquid delivery material is provided within the filter (14) of the smoking article (10).

24 Claims, 1 Drawing Sheet

(56) References Cited

U.S. PATENT DOCUMENTS

Figure 1:
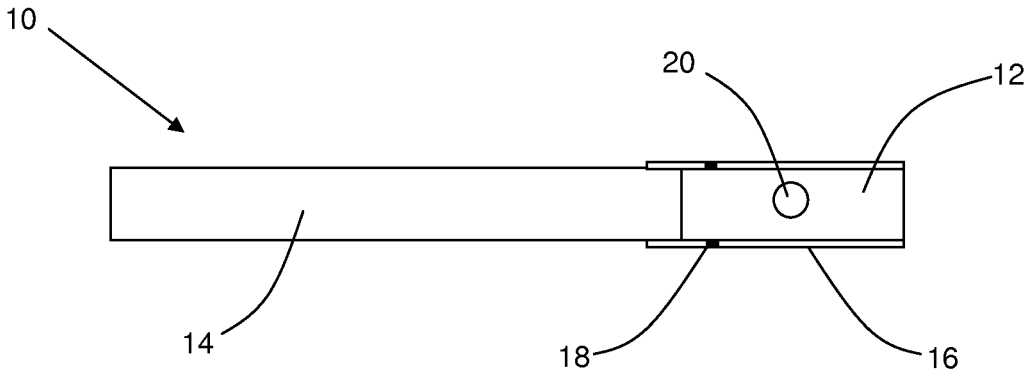

| | | | | |
|---|---|---|---|---|
| 3,428,049 | A * | 2/1969 | Cogbill | A24D 3/061 131/337 |
| 3,547,130 | A * | 12/1970 | Flint | A24D 3/061 131/274 |
| 4,687,008 | A * | 8/1987 | Houck, Jr. | A24D 3/041 131/191 |
| 4,889,144 | A * | 12/1989 | Tateno | A24D 3/061 131/331 |
| 5,221,502 | A | 6/1993 | Washington | |
| 7,644,716 | B2 | 1/2010 | Hosoya | |
| 7,793,665 | B2 * | 9/2010 | Dube | A24D 3/061 131/331 |
| 7,866,325 | B2 | 1/2011 | Woods | |
| 7,878,962 | B2 | 2/2011 | Karles | |
| 8,042,551 | B2 | 10/2011 | Tabuchi | |
| 8,459,272 | B2 | 6/2013 | Karles | |
| 8,739,802 | B2 | 6/2014 | Fagg | |
| 8,820,331 | B2 | 9/2014 | Hartmann | |
| 9,339,060 | B2 | 5/2016 | Hartmann | |
| 2006/0144412 | A1 | 7/2006 | Mishra | |
| 2007/0012327 | A1 * | 1/2007 | Karles | A24D 3/0216 131/337 |
| 2007/0062549 | A1 | 3/2007 | Holton, Jr. | |
| 2008/0142028 | A1 * | 6/2008 | Fagg | A24D 3/061 131/361 |
| 2008/0279947 | A1 | 11/2008 | Nowak | |
| 2009/0288667 | A1 | 11/2009 | Andresen | |
| 2010/0206317 | A1 * | 8/2010 | Albino | A24B 15/10 131/88 |

FOREIGN PATENT DOCUMENTS

| | | |
|---|---|---|
| CN | 101203148 | 6/2008 |
| CN | 101272703 | 9/2008 |
| EP | 2022349 | 7/2014 |
| GB | 1065204 | 4/1967 |
| GB | 194938 | 6/1970 |
| JP | 2010-505423 | 2/2010 |
| RU | 2267973 | 1/2006 |
| RU | 2314001 | 1/2008 |
| WO | WO 02/03819 | 1/2002 |
| WO | WO 2007/010407 | 1/2007 |
| WO | WO 2008/015573 | 2/2008 |
| WO | WO 2008/121610 | 10/2008 |
| WO | WO 2008/146161 | 12/2008 |
| WO | WO 2009/022232 | 2/2009 |
| WO | WO 2010/107613 | 9/2010 |
| WO | WO 2010/146845 | 12/2010 |
| WO | WO 2011/042174 | 4/2011 |
| WO | WO 2011/077141 | 6/2011 |
| WO | WO 2011/116975 | 9/2011 |
| WO | WO 2011/116979 | 9/2011 |

OTHER PUBLICATIONS

"MCT Oil 101—A Review of Medium-Chain Triglycerides",Authority Nutrition, 2016, pp. 1-2, [online], retrieved from the Internet,[retrieved Jun. 21, 2017],<URL:https://authoritynutrition.com/mct-oil-101/>.*

IUPAC, "Recommendations for the characterization of porous solids", Pure & Applied Chemistry, vol. 66, No. 8, pp. 1739-1758, [online], retrieved from the Internet, [retrieved Jan. 30, 2018, <URL: https://www.iupac.org/publications/pac/pdf/1994/pdf/6608x1739.pdf>.*

Notice of Allowance issued by the Kazakhstan Patent Office for Application No. 2014/1605.1, dated Sep. 22, 2015 (5 pages).

Office Action issued in Russia for Application No. 2014123203 dated Sep. 6, 2016 (13 pages). English translation included.

Office Action issued in Japan for Application No. 2014-540408 dated Sep. 28, 2016 (11 pages). English translation included.

Office Action issued in China for Application No. 101140951 dated Nov. 8, 2016 (9 pages). English translation included.

European Search Report for Application No. 11250885 (4 pages).

PCT International Search Report and Written Opinion for International Application No. PCT/EP2012/0071768 dated Apr. 4, 2013 (11 pages).

Office Action issued in China for Application No. 201280054545 dated Sep. 26, 2016 (19 pages). English translation included.

* cited by examiner

SMOKING ARTICLE WITH LIQUID DELIVERY MATERIAL

This application is a U.S. National Stage Application of International Application No. PCT/EP2012/071768, filed Nov. 2, 2012, which was published in English on May 16, 2013, International Patent Publication WO 2013/068304 A1. International Application No. PCT/EP2012/071768 claims priority to European Application No. 11250885.8 filed Nov. 7, 2011.

The present invention relates to a liquid delivery material that provides sustained release of a liquid upon compression of the material, and to a smoking article incorporating such a liquid delivery material.

It is well known to incorporate flavourant additives into smoking articles in order to provide additional flavours to the consumer during smoking. Flavourants may be used to enhance the tobacco flavours produced upon heating or combusting the tobacco material within the smoking article, or to provide additional non-tobacco flavours such as mint or menthol.

The flavourant additives used in smoking articles, such as menthol, are commonly in the form of a liquid flavourant which is incorporated into the filter or the tobacco rod of the smoking article using a suitable liquid carrier. Liquid flavourants are often volatile and will therefore tend to migrate or evaporate from the smoking article during storage. The amount of flavourant available to flavour the mainstream smoke during smoking is therefore reduced.

It has previously been proposed to reduce the loss of volatile flavourants from smoking articles during storage through the encapsulation of the flavourant, for example, in the form of a capsule or microcapsule. The encapsulated flavourant can be released prior to or during smoking of the smoking article by breaking open the encapsulating structure, for example by crushing or melting the structure. Where such capsules are crushed to release the flavourant, the capsules break open at a particular force and release all of the flavourant at that force. That is, the flavour is released from the capsules at a particular force, but flavour is not released prior to or after the particular force. Capsules and microcapsules therefore cannot provide a sustained release over a range of force.

It is also known to incorporate other types of non-flavourant liquid additives into smoking articles in order to adapt the smoke in some way during smoking. For example, certain liquid additives may be provided within a smoking article filter to alter the filtration properties of the filter during smoking.

It would be desirable to provide a novel material and mechanism for the delivery of a liquid additive in an aerosol generating device. In particular, it would be desirable to provide such a material and mechanism for the delivery of flavour in a smoking article which provides greater flexibility and control over the release of flavour during smoking. It would be particularly desirable to provide such a material that can provide a more selective release of flavour during smoking. It would further be desirable to provide a liquid delivery material for a smoking article which shows improved stability and improved retention of liquid additives during storage.

According to the invention there is provided an aerosol generating device incorporating a sustained-release liquid delivery material, the liquid delivery material comprising a closed matrix structure defining a plurality of domains. A liquid composition is trapped within the domains and is releasable from the closed matrix structure upon compression of the material. The liquid delivery material provides a sustained release of the liquid composition upon compression of the material over a range of force of at least 5 Newtons.

According to the invention there is also provided a smoking article incorporating a sustained-release flavour delivery material, the flavour delivery material comprising a closed matrix structure defining a plurality of domains. A flavour composition is trapped within the domains and is releasable from the closed matrix structure upon compression of the material. The flavour delivery material provides a sustained release of the flavour composition upon compression of the material over a range of force of at least 5 Newtons.

According to the invention there is further provided a filter incorporating a sustained-release flavour delivery material, the flavour delivery material comprising a closed matrix structure defining a plurality of domains. A flavour composition is trapped within the domains and is releasable from the closed matrix structure upon compression of the material. The flavour delivery material provides a sustained release of the flavour composition upon compression of the material over a range of force of at least 5 Newtons.

In the following description, any references to the features or properties of the sustained-release liquid delivery material or flavour delivery material according to the invention also apply to the liquid delivery material or flavour delivery material of filters or smoking articles according to the invention, unless stated otherwise.

As used herein, the term "aerosol generating device" is used to describe any consumer device that generates an aerosol from a substrate during use and delivers the aerosol to a consumer. In certain preferred embodiments, the aerosol generating device is a type of smoking article. In other embodiments, the aerosol generating device is a type of inhaler device.

Smoking articles according to the present invention incorporating the sustained-release liquid delivery material may be in the form of filter cigarettes or other smoking articles in which tobacco material is combusted to form smoke. The present invention additionally encompasses smoking articles in which tobacco material is heated to form an aerosol, rather than combusted, and smoking articles in which a nicotine-containing aerosol is generated from a tobacco material, tobacco extract, or other nicotine source, without combustion or heating. Smoking articles according to the invention may be whole, assembled smoking articles or components of smoking devices that are combined with one or more other components in order to provide an assembled device for producing an aerosol, such as for example, the consumable part of a heated smoking device.

As used herein, the term "smoke" is used to describe smoke produced by combustible smoking articles, such as filter cigarettes, and aerosols produced by non-combustible smoking articles, such as heated or non-heated smoking articles of the types described above.

In the following description, the invention will be described with reference to a smoking article incorporating a liquid delivery material that provides sustained release of a liquid composition. However, the teaching can also be applied to an alternative aerosol generation device for the sustained released of a liquid composition.

As used herein, the term "liquid" refers to compositions that are in a liquid state at room temperature (22° C.).

The term "liquid composition" refers to any liquid agent that can be incorporated into a component of an aerosol generating device in order to provide an effect on the aerosol or smoke generated during smoking. The liquid composition may be, for example, a substance that is capable of reducing one or more constituents of the aerosol. Alternatively, the liquid composition may be a substance that is capable of reacting with one or more other substances in the aerosol generating device to produce an aerosol. In preferred embodiments of the invention, the liquid composition is a liquid flavour composition and the liquid delivery material is adapted for providing flavour in a smoking article or a portion of a smoking article.

In the following description, the invention will be described with reference to a flavour delivery material that provides sustained release of a flavour composition. However, the teaching can also be applied to a material for the sustained released of an alternative liquid composition.

The term "sustained release" is used to indicate that the flavour delivery material is capable of releasing the flavour composition over a range of applied compressive force, over a range of deformation of the material, or both. For example, if the release of the flavour composition as a function of the applied compressive force is measured, it will be seen that the material is capable of releasing the flavour composition at a force of x Newtons and will continue to release the flavour composition as the force is increased from x Newtons to (x+y) Newtons (for example, where y is 5 Newtons).

Because they are ranges, the ranges of force and deformation described herein have a width and they extend between the ends of the ranges. For example, using the generic example above where y is 5 Newtons, the range of force would have a width of 5 Newtons and it would extend from x Newtons to (x+5) Newtons.

Since increasing the compressive force over the range of force will release further flavour composition from the flavour delivery material, the term "sustained release" can also be described as "progressive release". This is in contrast to prior art flavour release mechanisms for smoking articles in which flavour is released at a particular force, but flavour is not released prior to or after the particular force.

Those of skill in the art will understand that the term "sustained release" covers those embodiments in which the amount of flavour composition released at a given force depends additionally on the duration of the applied force. For example, in some embodiments, two brief applications of a given force may release the same amount of flavour composition as a single, extended application of the given force. In these embodiments, it is possible to use the sustained release properties of the material to provide multiple "doses" of the flavour composition by repeatedly applying the same or similar force to the flavour delivery material. In addition, multiple applications of progressively higher forces can also be used, which in some cases can increase the amount of flavour in the multiple "doses" that are released. Examples of these different types of sustained release are provided below.

As described below, when the flavour delivery material is in place within the smoking article, a compressive force is exerted on the material through the application of a compressive force to the part of the smoking article incorporating the material. However, unless stated otherwise, in the following description, the properties and parameters of the material are defined in relation to the material itself, apart from the smoking article. For example, the references to applied compressive force and deformation relate to the direct compression or deformation of the material when it is outside of a smoking article. In most cases, the material may be tested by cutting out or otherwise removing the material from the smoking article and testing the material directly.

Within the range of compressive force or deformation, the amount of the flavour composition that is released from the material is dependent on the compressive force applied or the deformation. There may be a substantially continuous relationship between the compressive force or deformation and the amount of flavour composition released. In this case, the amount of flavour composition released will increase substantially continuously as the compressive force applied or the deformation of the material increases. Alternatively, the flavour composition may be released in discrete amounts at certain forces within the defined range of compressive force or deformation, for example with some matrix materials described below. In this case, the amount of flavour composition released will increase in a step wise way as the compressive force or the deformation increases.

The sustained release flavour delivery profile provided by the flavour delivery material in smoking articles of the invention is in contrast to the flavour delivery profile of a capsule. Capsules are typically manufactured such that the outer shell of the capsule will break at a specific, defined compressive force. At that specific force, the outer shell will be crushed and substantially all of the flavourant contained within the core of the capsule will be released at the same time. However, at applied forces below that specific force, substantially no flavour will be released.

In relation to the present invention, the flavour composition is considered to be "released" from within the flavour delivery material when the flavour composition is exposed to the environment outside of the flavour delivery material. The flavour composition is considered to be "released" if it has been emitted from the flavour delivery material into surrounding space or material within the smoking article. Additionally, the flavour composition is considered to be "released" if it is still within the flavour delivery material but one or more open passageways for the volatilisation of the flavourants into the surrounding environment are provided. For example, a flavour composition within an open cell structure, such as a sponge, is considered to be "released".

Smoking articles of the present invention incorporate a novel type of flavour delivery material that provides sustained release of a flavour composition upon compression of the material with a compressive force over a range of forces. The flavour composition is substantially retained within the structure of the flavour delivery material and is released when the material is compressed, for example by crushing or pressing. The flavour delivery material is therefore advantageously capable of providing flavour on demand and acts as a type of flavour 'pump' within the smoking article.

As described above, the flavour delivery material provides a sustained-release delivery profile, such that the amount of the flavour composition released upon compression can be controlled through the adjustment of the compressive force applied by the consumer, for example over a range of at least 5 Newtons. This provides greater flexibility in the amount of flavour composition that can be released and therefore greater control over the intensity of flavour that is provided during smoking.

The sustained-release profile of the flavour delivery material additionally means that flavour composition is releasable more than once from the material. The application of a compressive force over a range of at least 5 Newtons may release only a portion of the available flavour composition from the material, such that the remainder of the flavour composition remains within the material for subsequent release. This feature of the flavour delivery material provides the consumer with a high level of control over the timing of the delivery of flavour during smoking, as well as the intensity of the flavour. The consumer may choose to release the flavour composition only once during smoking, for example, immediately prior to the final puff. Alternatively, the consumer may choose to release two or more bursts of the flavour composition at different times during smoking.

The stable retention of the flavour composition within the structure of the flavour delivery material until compression advantageously ensures that the loss of the flavour composition from the flavour delivery material during storage of a smoking article incorporating the material can be minimised. This is particularly advantageous where the flavour composition contains a volatile material that may otherwise vaporise during storage.

As a result of the improved retention of the flavour composition within the flavour delivery material, it is not necessary to add extra flavourant to compensate for the loss of flavourant during storage. In some cases, this enables a smaller amount of flavourant to be used, whilst still providing similar delivery of flavour.

In addition, the improved retention of the flavour composition within the flavour delivery material ensures that the flavour composition does not come into contact with other components of the smoking article prior to smoking. The flavour delivery material of the present invention is therefore particularly desirable for use in smoking article incorporating an adsorbent in a filter, such as activated carbon, active aluminium, zeolites, sepiolites, molecular sieves and silica gel.

The present invention further provides a smoking article incorporating a sustained-release flavour delivery material comprising a flavour composition that is releasable upon compression of the material over a range of deformation of at least 25 percent deformation. That is, the range of deformation has a width of at least 25 percent deformation. The deformation of the material will typically increase with increasing compressive force. The percent deformation of the material corresponds to the reduction in dimension of the material upon application of a compressive force in the direction in which the compressive force is applied. The flavour delivery material is capable of releasing the flavour composition over a range of deformation.

As described above in relation to the sustained release of the flavour composition over a range of force, the amount of flavour composition released may increase substantially continuously with increasing deformation of the material over the defined range. Alternatively, the amount of flavour composition released may increase in a step wise manner over the defined range of deformation.

The flavour delivery material of the smoking articles of the present invention will have a characteristic flavour release profile. The "flavour release profile" of the flavour delivery material refers to the way in which the release of the flavour composition from the flavour delivery material varies as a function of the applied compressive force, or the deformation of the material.

Preferably, the flavour delivery material provides a sustained release of the flavour composition upon compression of the material over a range of force of at least about 8 Newtons, more preferably at least about 10 Newtons, most preferably at least about 20 Newtons.

Preferably, the flavour delivery material provides a sustained release of the flavour composition upon compression of the material over a range of force from about 10 Newtons to about 15 Newtons. That is, the range of force preferably extends from about 10 Newtons to about 15 Newtons.

Particularly preferably, the flavour delivery material provides a sustained release of the flavour composition over a broader range of force, for example over a range of force from about 5 Newtons to about 50 Newtons. This could also be described as a range extending from about 5 Newtons to about 50 Newtons. More preferably, the flavour delivery material provides a sustained release of flavour composition over a range of force from about 5 Newtons to about 25 Newtons, most preferably from about 5 Newtons to about 20 Newtons.

Preferably, the amount of the flavour composition released upon compression of the flavour delivery material with a force of about 5 Newtons corresponds to at least about 2 percent by weight and preferably at least about 4 percent by weight of the flavour delivery material prior to any compression. Preferably, the additional amount of the flavour composition that is released upon further compression of the flavour delivery material with a force of about 10 Newtons (up to a total of 15 Newtons) corresponds to at least 10 percent by weight of the flavour delivery material prior to any compression.

Preferably, the amount of the flavour composition released upon compression of the flavour delivery material with a force of about 10 Newtons corresponds to at least about 15 percent by weight and more preferably at least about 20 percent by weight of the flavour delivery material prior to any compression. Preferably, the additional amount of the flavour composition that is released upon further compression of the flavour delivery material with a force of about 15 Newtons (up to a total of 25 Newtons) corresponds to at least 10 percent by weight of the flavour delivery material prior to any compression.

Preferably, the flavour delivery material provides a sustained release of the flavour composition upon compression of the material over a range of deformation of at least about 25 percent, more preferably at least about 30 percent. Preferably, the flavour delivery material provides a sustained release of the flavour composition upon compression of the material over a range of deformation from about 10 percent deformation to about 40 percent deformation, more preferably over a range of deformation from about 10 percent deformation to about 50 percent deformation.

Preferably, the amount of the flavour composition released upon deformation of the flavour delivery material to about 10 percent corresponds to at least about 2 percent by weight and more preferably at least about 4 percent by weight of the flavour delivery material prior to any compression. Preferably, the additional amount of the flavour composition that is released upon further deformation of the flavour delivery material to about 40 percent corresponds to at least 10 percent by weight of the flavour delivery material prior to any compression.

Preferably, the amount of the flavour composition released upon deformation of the flavour delivery material to about 25 percent corresponds to at least about 5 percent by weight and more preferably at least about 8 percent by weight of the flavour delivery material prior to any compression. Preferably, the additional amount of the flavour composition that is released upon further deformation of the flavour delivery material to about 40 percent corresponds to at least 10 percent by weight of the flavour delivery material prior to any compression.

It is assumed that most, if not all of the weight loss exhibited upon compression or deformation of the flavour delivery material is as a result of the release of the flavour composition from the material. The amount of flavour composition released from the material can therefore be determined by measuring the difference in the weight of the flavour delivery material before and after compression and calculating the percentage reduction in the total weight of the flavour delivery material. As defined above, the weight loss is calculated with reference to the initial weight of the flavour delivery material prior to any compression. A suitable method for evaluating the release of flavour composition from the flavour delivery material upon application of a compressive force or deformation is set out in the examples described below.

In certain embodiments, the flavour delivery material of the smoking articles of the present invention may passively release a low level of the flavour composition over time in the absence of an applied compressive force. For example, during production of the flavour delivery material, a small amount of the flavour composition may not be effectively trapped within the flavour delivery material and may therefore remain on the surfaces of the material. This small amount of residual flavour composition is therefore immediately available for contact with the smoke. In this way, a low base level of flavour can be provided during smoking even without compression of the flavour delivery material to release the flavour composition. Upon compression of the flavour delivery material, the same flavour is maintained but with an increased intensity.

Alternatively or in addition, the smoking articles of the present invention may be provided with an additional flavour source which passively releases a low level of a flavourant into the smoke, independently from the flavour delivery material. The additional flavour source may release the same flavour as the flavour delivery material, or a different flavour. Suitable additional flavour sources include, for example, a flavour thread or cellulosic flavour beads impregnated with a liquid flavourant.

Such embodiments in which flavourant is available to the smoke prior to compression of the flavour delivery material provide a "flavour to flavour" profile. In such smoking articles there is a transition in the intensity or the character of the flavour, or both, upon compression of the flavour delivery material.

In alternative embodiments, smoking articles according to the invention may provide a "non-flavour to flavour" profile. This means that there is substantially no delivery of additional flavour into the mainstream smoke until compression of the flavour delivery material to release the flavour composition. No additional flavourants are therefore incorporated into the filter of the smoking article.

The flavour delivery material of the smoking articles of the present invention retains the flavour composition within the structure of the material until a compressive force is applied to the material. To achieve such retention of the flavour composition, the flavour delivery material comprises a closed matrix or network structure, which traps the flavour composition within the closed structure. That is, the flavour composition is trapped in domains within a matrix structure. Upon compression of the material, the flavour composition is forced out from the matrix structure, for example, through the breakage of the surrounding structure.

In preferred embodiments of the present invention, the flavour delivery material comprises a polymer matrix comprising one or more matrix-forming polymers. In particularly preferred embodiments, the polymer matrix forms the plurality of domains including the flavour composition.

In such embodiments, the flavour delivery material includes a three-dimensional structural matrix of a polymer material that forms a network defining the plurality of domains. The term "domain" is used throughout the present specification to refer to the closed pores or pockets that contain the flavour composition or the distinct regions or, for certain manufacturing processes for matrix materials, droplets of the flavour composition that are dispersed within the precursor materials of the polymer matrix, as further described below. The flavour composition is dispersed through the polymer matrix in a plurality of discrete domains which are surrounded and enclosed by the polymer matrix.

The polymer matrix of the flavour delivery material isolates the flavour composition so that the flavourant is substantially retained within the structure of the polymer matrix until the flavour delivery material is compressed. Compression of the flavour delivery material results in deformation of the polymer matrix. As the level of applied force, deformation, or both force and deformation increases, the matrix is gradually broken down and the domains begin to rupture, such that the flavour composition retained within the domains is released.

The gradual breakdown of the polymer matrix with increasing compressive force provides the sustained-release flavour delivery profile of the flavour delivery material. For example, within a range of force of at least 5 Newtons, the domains within the flavour delivery material continue to be ruptured as the compressive force increases, such that the flavour composition is released across the range. At a certain level of applied force, the majority of the domains will have been ruptured and an increase in the compressive force about this level will no longer result in the release of further flavour composition.

In accordance with the definition set out above, the flavour composition is considered to be "released" when the structure of the domain containing the flavour composition is broken apart such that the domain is open to the surrounding environment. As described above, some of the "released" flavour composition may immediately escape from the flavour delivery material as a result of the applied compressive force. In addition, some of the "released" flavour composition may initially remain within the space of the domain but gradually migrate out of the domain through any openings in the domain structure.

Typically, when the flavour delivery material is in place within the smoking article, the compression of the material by the consumer will only initially result in the rupture of a portion of the domains. The remainder of the domains therefore remain closed with the flavour composition trapped inside until a further compressive force is applied. The domain structure is therefore particularly well adapted to provide a flavour delivery material for multiple releases of flavour during smoking.

In particularly preferred embodiments, the polymer matrix of the flavour delivery material comprises a plasticiser in addition to the one or more matrix-forming polymers.

The term "plasticiser" refers to a substance or material incorporated in the matrix forming material to increase its flexibility or workability. Many plasticisers tend to decrease the intermolecular forces between polymer chains, resulting in the increased flexibility and compressibility, or they may exert a plasticising effect because they cause discontinuities in a polymer matrix. Examples of classes of plasticisers are saccharides (mono-, di- or oligo-saccharides), alcohols, polyols, acid salts, lipids and derivatives (such as fatty acids, monoglycerides, esters, phospholipids) and surfactants. Specific examples of suitable plasticisers include but are not limited to: glucose, fructose, honey, sorbitol, polyethylene glycol, glycerol, propylene glycol, lactitol, sodium lactate, hydrated hydrolyzed starches, trehalose, or combinations thereof. Other suitable plasticisers for use in the present invention could be identified by the skilled person based on the examples provided.

In the flavour delivery material of the smoking articles of the present invention, the plasticiser may be incorporated into the polymer matrix in order to soften the matrix such that the material is more compressible. This enables the flavour delivery material to more effectively provide the sustained-release flavour delivery profile as described above. In particular, the plasticiser may increase the range of force over which a sustained delivery of the flavour composition can be provided or decrease the amount of force required to begin releasing the flavour composition.

Preferably, the plasticiser is incorporated into the polymer matrix in an amount corresponding to at least 5 percent by weight of the matrix-forming polymers, more preferably at least 10 percent by weight of the matrix-forming polymers. The ratio of the plasticiser to the matrix-forming polymers in the polymer matrix is preferably at least 1:20 and more preferably at least 1:10. In addition, or in the alternative, the ratio is preferably less than about 1:2.

The polymer matrix may comprise at least about 0.1 percent by weight of the plasticiser, based on the total combined weight of the matrix-forming polymers and plasticiser. Alternatively or in addition, the polymer matrix may comprise less than about 25 percent by weight, preferably less than about 20 percent by weight and most preferably less than about 18 percent by weight of the plasticiser, based on the total combined weight of the matrix-forming polymers and plasticiser. Preferably, the polymer matrix comprises between about 0.1 percent and about 25 percent by weight, more preferably between about 0.1 percent and about 20 percent by weight and most preferably between about 0.1 percent and about 18 percent by weight of the plasticiser, based on the total weight of the matrix-forming polymers and plasticiser.

The polymer matrix may comprise at least about 75 percent by weight, more preferably at least about 80 percent by weight and most preferably at least about 82 percent by weight of the matrix-forming polymers, based on the total combined weight of the matrix-forming polymers and plasticiser. Alternatively or in addition the polymer matrix may comprise less than about 99.9 percent by weight of the matrix forming polymers, based on the total combined weight of the matrix-forming polymers and plasticiser. Preferably, the polymer matrix may comprise between about 75 percent and about 99.9 percent by weight, more preferably between about 80 percent and about 99.9 percent by weight and most preferably between about 82 percent and about 99.9 percent by weight of the matrix forming polymers based on the total combined weight of the matrix-forming polymers and plasticiser.

The polymer matrix is preferably a cross-linked polymer matrix. The cross-linking of the one or more polymers forming the matrix provides structural strength and stability which improves the resistance of the polymer matrix to heat and shear forces to which the material may be subjected during manufacture or processing of the smoking articles incorporating the material. The matrix structure also provides effective trapping of the flavour composition with the flavour delivery material. Preferably, the cross-linked polymer matrix is water or moisture resistant. The polymer matrix may be formed from a single type of cross-linkable polymer or a combination of cross-linkable polymers.

Preferably, the polymer matrix comprises one or more polysaccharides. Polysaccharides are particularly suitable for use in the present invention, since they can be made water insoluble and heat stable through cross-linking, and are tasteless. Preferably, the polymer matrix comprises a combination of two or more polysaccharides, wherein the two or more polysaccharides are capable of cross-linking with one another. In some embodiments, the polymer matrix comprises alginate and pectin, wherein the alginate and pectin are cross-linked with each other. In some embodiments, the polymer matrix comprises at least about 20 percent by weight pectin. Further, the polymer matrix may have at least about 60 percent by weight alginate. Preferably, the polymer matrix has between about 20 percent by weight and about 40 percent by weight pectin and between about 60 percent by weight and about 80 percent by weight alginate. Preferably, the ratio of alginate to pectin is about 2:1, or between about 1.8:1 and about 2.2:1.

The cross-linking of the polymer matrix is preferably achieved through reaction of the polymers with multivalent cations which form salt bridges to cross-link the polymers. The multivalent cations are preferably provided in the form of a solution of a multivalent metal salt, such as a solution of a metal chloride. Preferred multivalent cations include calcium, iron, aluminium, manganese, copper, zinc or lanthanum. A particularly preferred salt is calcium chloride.

The flavour composition of the flavour delivery material incorporated into the smoking articles of the present invention preferably includes a flavourant mixed with one or more fats. It is particularly preferred that the one or more fats are liquid at room temperature (22° C.), or have a melting point below 22° C. For the purposes of the present invention, the "melting point" of a fat is measured using differential scanning calorimetry (DSC).

The one or more liquid fats act as a carrier for the flavourant and can be referred to as an "excipient". The flavourant is blended with the excipient to form the flavour composition. In certain embodiments, the flavourant is dispersed or dissolved in the excipient.

The use of an excipient for the flavourant that is liquid at room temperature is particularly advantageous, since the flavour composition can more readily be released from the flavour delivery material upon compression. Furthermore, with a liquid excipient, the flavourants will typically be more available to the surrounding environment after the release of the flavour composition from the material. This is because the volatile flavour compounds can be more readily releasable from liquid carriers than solid carriers.

In addition, the use of a liquid excipient advantageously improves the dispersion of the flavour composition within the filter material after the flavour composition has been released from the flavour delivery material. For example, where the filter is formed of a fibrous filtration material, the flavour composition will more readily spread through the fibres such that a greater surface area of the filtration material is covered by the flavour composition. This in turn improves the level of contact between the smoke and the flavour composition as the smoke is drawn through the filter such that the transfer of the flavourant into the smoke is enhanced. Preferably, the one or more liquid fats of the flavour composition have a neutral odour and taste. The fats therefore have a minimal impact of the flavour provided by the flavourant mixed with the fats.

Preferably, the liquid fat in the flavour composition includes at least about 30 percent by weight, preferably at least about 50 percent by weight, more preferably at least about 75 percent by weight, and most preferably about 100 percent by weight triglycerides having one or more carboxylic acids with a chain length between 6 and 12. Alternatively, the liquid fat includes at least about 30 percent by weight, preferably at least about 50 percent by weight, more preferably at least about 75 percent by weight, and most preferably about 100 percent by weight triglycerides having all three carboxylic acid chain lengths between 6 and 12.

Particularly preferably, the liquid fat in the flavour composition includes at least about 30 percent by weight, preferably at least about 50 percent by weight, more preferably at least about 75 percent by weight, and most preferably about 100 percent by weight triglycerides having one or more carboxylic acids with a chain length between 8 and 10. Alternatively, the liquid fat includes at least about 30 percent by weight, preferably at least about 50 percent by weight, more preferably at least about 75 percent by weight, and most preferably about 100 percent by weight triglycerides having all three carboxylic acid chain lengths between 8 and 10.

A triglyceride is an ester derived from glycerol and three fatty acids, or carboxylic acids. The "chain length" of a carboxylic acid chain in a triglyceride refers to the number of carbon atoms in the backbone of the carboxylic acid. For example, a carboxylic acid chain length of 12 is formed from glycerol and a fatty acid having 12 carbon atoms in the backbone of the aliphatic tail of the fatty acid. Triglycerides having one or more carboxylic acid chain lengths of between 6 and 12 are typically referred to as medium chain triglycerides (MCTs).

Medium chain triglycerides are particularly suitable for use in the flavour delivery material of smoking articles of the present invention since they are in a stable liquid form at room temperature (22° C.). Furthermore, MCTs provide a neutral odour and taste, which will have a negligible effect on the flavour provided by the flavour composition during smoking. In addition, at a chain length of between 6 and 12, there is advantageously found to be a minimal transfer of the fat components into the smoke.

In particularly preferred embodiments of the invention, the flavour composition comprises a flavourant mixed with MCT oil, for example caprylic/capric triglyceride from fractionated coconut oil. An example of a suitable MCT oil is the commercially available MIGLYOL® 810.

The one or more triglycerides may be provided as individual components, or may be provided in a material including one or more medium chain triglycerides in combination with other components.

The carboxylic acid chains of the medium chain triglycerides of the flavour composition may be saturated such that all bonds between the carbon atoms in the chain are single bonds, or at least partially unsaturated such that the chain includes at least one double or triple bond between two carbon atoms in the chain. Preferably, there are more saturated chains in the triglyceride compounds than unsaturated chains. In some cases, the ratio of saturated to unsaturated chains is at least about 1.6, more preferably at least about 1.8 and most preferably at least 2.0. The greater relative amount of saturated chains can make the product more stable over time, in some cases increasing the potential shelf life of the product.

The flavour composition may include a combination of two or more triglycerides having different chain lengths to each other. For example, the flavour composition may comprise an oil or fat including a mixture of medium chain triglycerides, optionally in combination with other short chain (for example, triglycerides win which all of the chain lengths are less than 6) or long chain triglycerides (for example, triglycerides win which all of the chain lengths are longer than 12). The oil or fat including the triglycerides may be of vegetable origin, animal origin, or artificially produced.

The flavourant of the flavour composition includes one or more flavour compounds for providing a desired flavour upon heating of the flavour delivery material. Suitable flavourants for use in the flavour delivery material of the present invention would be well known to the skilled person. Preferably, the flavourant is soluble in the excipient at room temperature, such that the flavour composition is a liquid. The flavourant may include one or more natural flavourants, one or more synthetic flavourants, or a combination of natural and synthetic flavourants.

A variety of flavours could be used in the flavour delivery material of the smoking articles of the present invention. In some embodiments, the flavourant is a high potency flavourant, and is typically used at levels that would result in less than 200 parts per million in the smoke. Examples of such flavourants are key tobacco aroma compounds such as beta-damascenone, 2-ethyl-3,5-dimethylpyrazine, phenylacetaldehyde, guaiacol, and furaneol.

In embodiments in which the flavourant consists only of one or more high potency flavourants and it is desired that the flavourant be released at a lower level in the smoke as described above, any of the high potency flavourants mentioned above can be added to the flavour composition at a level of at least about 1 part per million. Alternatively or in addition, the high potency flavourants are added to the flavour composition at a level of less than about 375 parts per million, preferably less than about 325 parts per million, more preferably less than about 325 parts per million. Preferably, the high potency flavourants are added to the flavour composition at a level of between about 1 part per million to about 375 parts per million, more preferably between about 1 part per million to about 325 parts per million and most preferably between about 1 part per million and about 275 parts per million.

In such embodiments in which the flavourant consists only of one or more high potency flavourants, the remainder of the flavour composition preferably consists of the excipient comprising one or more liquid fats.

Other flavourants can only be sensed by humans at higher concentration levels. These flavourants, which are referred to herein as low potency flavourants, are typically used at levels that result in orders of magnitude higher amounts of flavourant being released into the smoke. Suitable low potency flavourants include, but are not limited to, natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole and linalool.

If desired, one or more of the high potency flavourants mentioned above may be used in combination with one or more low potency compounds for example in the amounts described above.

Preferably, the flavourant includes an essential oil, or a mixture of one or more essential oils. An "essential oil" is an oil having the characteristic odour and flavour of the plant from which it is obtained. Suitable essential oils for inclusion in the flavour granules of the present invention include, but are not limited to, peppermint oil and spearmint oil.

In preferred embodiments of the invention, the flavourant comprises menthol, Eugenol, or a combination of menthol and Eugenol. These flavour types are commonly used to provide a refreshing flavour to the smoke of a smoking article. In a particularly preferred embodiment of the invention, the flavour composition comprises menthol dispersed in MCT Oil.

In embodiments in which the flavour composition comprises one or more low potency flavourants, the flavour composition may comprise at least about 15 percent by weight, preferably at least about 20 percent by weight and most preferably at least about 25 percent by weight of the low potency flavourants. Alternatively or in addition, the flavour composition may comprise less than about 50 percent by weight, more preferably less than about 40 percent by weight and most preferably less than about 35 percent by weight of the low potency flavourants. Preferably, the flavour composition comprises between about 15 percent and about 50 percent by weight, more preferably between about 20 percent and about 40 percent by weight and most preferably between about 25 percent and about 35 percent by weight of the low potency flavourants.

In such embodiments comprising one or more low potency flavourants, the flavour composition may comprise at least about 50 percent by weight, more preferably at least about 60 percent by weight and most preferably at least about 65 percent by weight of the excipient comprising one or more liquid fats. Alternatively or in addition, the flavour composition may comprise less than about 85 percent by weight, more preferably less than about 80 percent by weight and most preferably less than about 75 percent by weight of the excipient. Preferably, the flavour composition comprises between about 50 percent and about 85 percent by weight, more preferably between about 60 percent and about 80 percent by weight and most preferably between about 65 percent and about 75 percent by weight.

Where the flavourant is a low potency flavourant such as menthol, the flavour delivery material may comprise at least about 12 percent by weight, preferably at least about 15 percent by weight and more preferably at least about 20 percent by weight of any one or more of the low potency flavourants described herein. Alternatively or in addition, the flavour delivery material may comprise less than about 40 percent by weight, preferably less than about 35 percent by weight and more preferably less than about 30 percent by weight of any one or more of the low potency flavourants described herein. Preferably, the flavour delivery material comprises between about 12 percent by weight and about 40 percent by weight of low potency flavourant, more preferably between about 15 percent by weight and about 35 percent by weight of low potency flavourant, or most preferably between about 20 percent by weight and about 30 percent by weight of low potency flavourant. In particularly preferred embodiments, the low potency flavourant comprises menthol.

Where the flavourant is a low potency flavourant, the flavour delivery material also preferably comprises at least about 40 percent by weight, and preferably at least about 50 percent by weight of any one or more of the liquid fats described herein. Alternatively or in addition, the flavour delivery material comprises less than about 70 percent by weight, preferably less than about 65 percent by weight and more preferably less than about 60 percent by weight of any one or more of the liquid fats described herein. Preferably, the flavour delivery material comprises between about 40 percent and about 70 percent by weight, more preferably between about 50 percent and about 65 percent by weight and most preferably between about 50 percent and about 60 percent by weight of any one or more of the liquid fats described herein.

Where the flavourant is a low potency flavourant, the flavour delivery material may comprise at least about 8 percent by weight, and preferably at least about 10 percent by weight of the polymer matrix materials described herein. Alternatively or in addition, the flavour delivery material may comprise less than about 20 percent by weight, preferably less than about 18 percent by weight and more preferably less than about 16 percent by weight of the polymer matrix materials described herein. Preferably, the flavour delivery material comprises between about 8 percent and about 20 percent by weight, more preferably between about 10 percent and about 18 percent by weight and most preferably between about 10 percent and about 16 percent by weight of any one or more of the polymer matrix materials described herein.

Where the flavourant is a low potency flavourant, the flavour delivery material preferably comprises at least about 0.1 percent by weight of plasticiser. Alternatively or in addition, the flavour delivery material may comprise less than about 5 percent by weight, preferably less than about 3 percent by weight and more preferably less than about 2 percent by weight of plasticiser. Preferably, the flavour delivery material comprises between about 0.1 percent and about 5 percent by weight, more preferably between about 0.1 percent and about 3 percent by weight and most preferably between about 0.1 percent and about 2 percent by weight of any one or more of the polymer matrix materials described herein.

Where the flavourant is a high potency flavourant such as those described above, the flavour delivery material may comprise greater than 1 part per million flavourant. Alternatively or in addition, the flavour delivery material may comprise less than 300 parts per million flavourant, preferably less than about 260 parts per million and more preferably less than about 220 parts per million flavourant. Preferably, the flavour delivery material comprises between about 1 part per million and about 300 parts per million, more preferably between about 1 part per million and about 260 parts per million and most preferably between about 1 part per million and about 220 parts per million flavourant.

Where the flavourant is a high potency flavourant, the remainder of the flavour delivery material, including everything other than the high potency flavourant, may comprise at least about 50 percent by weight, preferably at least about 60 percent by weight and more preferably at least 75 percent by weight of any one or more of the liquid fats described herein. Alternatively or in addition, the remainder of the flavour delivery material comprises less than about 80 percent by weight of any one or more of the liquid fats described herein. More preferably, the remainder of the flavour delivery material comprises between about 50 percent and about 80 percent by weight, more preferably between about 60 percent and about 80 percent and most preferably between about 75 percent and about 80 percent by weight, of any one or more of the liquid fats described herein.

Further, where the flavourant is a high potency flavourant, the remainder of the flavour delivery material, including everything other than the high potency flavourant, may comprise at least about 8 percent by weight, more preferably at least 10 percent by weight of any one or more of the polymer matrix materials described herein. Alternatively or in addition, the remainder of the flavour delivery material may comprise less than about 20 percent by weight, preferably less than about 18 percent by weight and more preferably less than about 16 percent by weight of any one or more of the polymer matrix materials described herein.

Preferably, the remainder of the flavour delivery material comprises between about 8 percent and about 20 percent by weight, more preferably between about 10 percent by weight and about 18 percent by weight and most preferably between about 10 percent and about 16 percent by weight of any one or more of the polymer matrix materials described herein.

Where the flavourant is a high potency flavourant, the flavour delivery material preferably comprises at least about 0.1 percent by weight of plasticiser. Alternatively or in addition, the flavour delivery material may comprise less than about 5 percent by weight, preferably less than about 3 percent by weight and more preferably less than about 2 percent by weight of plasticiser. Preferably, the flavour delivery material comprises between about 0.1 percent and about 5 percent by weight, more preferably between about 0.1 percent and about 3 percent by weight and most preferably between about 0.1 percent and about 2 percent by weight of any one or more of the polymer matrix materials described herein.

In some embodiments, the flavour delivery material consists only of, or consists essentially of, the polymers of the polymer matrix, one or more plasticiser materials, one or more flavourants and one or more fats, such as one or more medium chain triglycerides. In alternative embodiments, the flavour delivery material comprises one or more additional components.

The flavour delivery material as described above may advantageously be incorporated into a wide variety of different types of smoking articles. For example, the flavour delivery material may be incorporated into combustible smoking articles, such as filter cigarettes, having a rod of tobacco cut filler or other smokable material, which is combusted during smoking.

Alternatively, the flavour delivery material may be incorporated into heated smoking articles of the type described above in which material is heated to form an aerosol, rather than combusted. For example, the flavour delivery material may be incorporated into a heated smoking article comprising a combustible heat source, such as that disclosed in WO-A-2009/022232, which comprises a combustible heat source and an aerosol-generating substrate downstream of the combustible heat source. The flavour delivery material may also be incorporated into heated smoking articles comprising non-combustible heat sources, for example, chemical heat sources or electrical heat sources such as electrical resistive heating elements.

Alternatively, the flavour delivery material as described above may be incorporated into smoking articles in which a nicotine-containing aerosol is formed from a tobacco material or other nicotine source without combustion and without heating, such as those described in WO-A-2008/121610 and WO-A-2010/107613.

Smoking articles according to the present invention may incorporate the flavour delivery material in any one or more of the components of the smoking article. The smoking article component or portion of the component incorporating the flavour delivery material should be deformable, such that a compressive force can be applied to the flavour delivery material through the compression of the component. Preferably, the flavour delivery material is incorporated into the filter or mouthpiece of the smoking article. The filter or mouthpiece may be compressed in order to apply a compressive force to the flavour delivery material to release the flavour composition into the surrounding filter. During smoking of the smoking article, the flavourant from the portion of the flavour composition that has been released from the flavour delivery material is delivered into the smoke that passes through the filter.

The filter may be a single segment filter, formed of a single segment incorporating the flavour delivery material. Alternatively, the filter may be a multi-component filter comprising at least one filter segment incorporating the flavour delivery material and at least one additional filter segment. A variety of suitable filter segments would be well known to the skilled person including but not limited to fibrous filter tows, cavity filter segments, tubular filter segments and flow restrictor segments. One or more of the filter segments may comprise an additional flavour material, a sorbent material, or a combination of a flavour material and a sorbent material.

For example, one or more of the filter segments may comprise an additional flavour material in order to provide a "flavour to flavour" profile, as described above. In such cases, the additional flavour material typically passively releases flavourant into the filter such flavour is delivered into the smoke prior to the compression of the flavour delivery material. Upon compression of the flavour delivery material, there is a transition in the intensity of the flavour delivery, the character of the flavour, or both. The additional flavour material may comprise, for example, a flavour thread impregnated with a liquid flavourant, one or more cellulosic flavour granules, a sorbent material such as activated carbon having a liquid flavourant loaded in or on the sorbent, or combinations thereof.

In alternative embodiments in which an additional flavour material is not provided, the smoking article will typically provide a "non-flavour to flavour" profile, as described above. In such smoking articles, the first flavour to be released into the smoke will be that released from the flavour delivery material.

In certain preferred embodiments of the invention, the flavour delivery material is incorporated within a segment of a fibrous filtration material, such as cellulose acetate tow. In such embodiments, one or more portions of the flavour delivery material are preferably dispersed through the fibrous filtration material during production of the filter segment such that in the assembled filter, the flavour delivery material is embedded within the segment. Upon compression of the filter and the flavour delivery material within the filter, the flavour composition is released into the surrounding fibrous filtration material. Advantageously, where the flavour composition comprises a liquid excipient, such as one or more liquid fats, the flavour composition is readily dispersed amongst the fibrous filtration material upon release from the flavour delivery material, as described above. The flavour composition thereby coats the fibres of the filtration material to optimise the transfer of the flavourants into the smoke.

In alternative embodiments of the invention, the flavour delivery material is incorporated within a cavity in the filter. For example, the flavour delivery material may be incorporated within a cavity between two filter plugs, wherein the cavity is defined by a filter wrapper surrounding the filter.

Preferably, the flavour delivery material within the filter is visible to the consumer through the one or more layers of wrapping material circumscribing the filter. Suitable arrangements for providing a filter with visibility of the filter material would be known to the skilled person.

The flavour delivery material may advantageously be provided within smoking articles according to the invention in a variety of different forms so that there is flexibility in the way in which the material can be incorporated into the smoking article. In certain embodiments the flavour delivery material is provided in the form of beads. The beads may be formed into any suitable shape, but are preferably substantially cylindrical or spherical.

The width of the beads may be greater than about 1 mm, preferably greater than about 2 mm, and more preferably greater than about 3 mm. Alternatively or in addition, the width of the beads may be less than about 8 mm, preferably less than about 6 mm, and more preferably less than about 4 mm. Preferably, the width of the beads is between about 1 mm and about 8 mm, more preferably between about 2 mm and about 6 mm, even more preferably between about 3 mm and about 4 mm.

The "width" of the beads corresponds to the maximum dimension of the transverse cross section of the bead, wherein the transverse cross section refers to the cross section taken through a bead that is in place within a smoking article in a direction substantially perpendicular to the longitudinal axis of the smoking article. For a substantially spherical bead, the width of the bead substantially corresponds to the diameter of the bead.

A single bead may be provided within the smoking article, or a plurality of beads may be provided, for example two or more, three or more, or four or more beads. Where a plurality of beads is provided, the beads may be spaced apart along the smoking article, or may be placed in one or more specific regions of the smoking article, for example within the filter. One or more beads of the flavour delivery material can be inserted into the smoking articles according to the invention using known apparatus and methods for inserting objects into filters or tobacco rods.

Alternatively, the flavour delivery material may be in the form of strips or flakes, which can be distributed through the materials forming one or more components of the smoking article, or at one or more desired locations along the smoking article.

Alternatively again, the flavour delivery material may be in the form of an elongate filament or yarn, which can be introduced into a component of the smoking article, such as the filter or mouthpiece. A continuous filament may be provided along the full length of one or more of the smoking article components during manufacture, or individual pieces of the filament may be deposited at one or more desired locations along the one or more components. The filament preferably has a width of greater than about 1 mm, preferably greater than about 2 mm, and more preferably greater than about 3 mm. Alternatively or in addition, the width of the filament may be less than about 8 mm, preferably less than about 6 mm, and more preferably less than about 4 mm. Preferably, the width of the filament is between about 1 mm and about 8 mm, more preferably between about 2 mm and about 6 mm, even more preferably between about 3 mm and about 4 mm.

As described above with reference to beads, the "width" corresponds to the maximum dimension of the transverse cross section of the filament, wherein the transverse cross section refers to the cross section taken through a filament that is in place within a smoking article in a direction substantially perpendicular to the longitudinal axis of the smoking article.

The flavour delivery material may be coloured, if desired, through the inclusion of a colourant. Preferably, a colourant is incorporated into the flavour delivery material in order to adjust the colour of the material so that it resembles the colour of the material in the component of the smoking article in which the flavour delivery material is incorporated. For example, if the flavour delivery material is incorporated into the tobacco rod of a smoking article, the flavour delivery material may be brown or green in colour. The flavour delivery material therefore has a low visibility in the tobacco rod.

Smoking articles according to the invention may each include greater than about 1 mg and preferably greater than about 3 mg of any of the flavour delivery materials described herein. Alternatively or in addition, each smoking article may include less than about 20 mg, preferably less than about 12 mg, and more preferably less than about 8 mg of any of the flavour delivery materials described herein. Preferably, each smoking article includes between about 1 mg and about 20 mg, more preferably between about 1 mg and about 12 mg, and most preferably between about 3 and about 8 mg of the flavour delivery material.

Preferably, the overall length of smoking articles according to the present invention is between about 70 mm and about 128 mm, more preferably about 84 mm.

Preferably, the external diameter of smoking articles according to the present invention is between about 5 mm and about 8.5 mm, more preferably between about 5 mm and about 7.1 mm for slim sized smoking articles or between about 7.1 mm and about 8.5 mm for regular sized smoking articles.

Preferably, the overall length of the filters of smoking articles according to the present invention is between about 18 mm and about 36 mm, more preferably about 27 mm.

Smoking articles according to the present invention may be packaged in containers, for example in soft packs or hinge-lid packs, with an inner liner coated with one or more flavourants.

According to the present invention there is also provided a method for producing the flavour delivery material as described above. The method comprises the steps of forming a flavour composition by dispersing any of the flavourants described above in one or more fats that are liquid at room temperature (22° C.); mixing the flavour composition with a matrix polymer solution comprising one or more matrix-forming polymers and a plasticiser to form an emulsion; and adding the emulsion to a cross-linking solution to cross-link the matrix polymer solution to form a polymer matrix including a plurality of domains of the flavour composition.

Preferably, the flavourant is mixed with the one or more fats at room temperature (22° C.) to form the flavour composition. Preferably, the flavour composition is then mixed with the matrix polymer solution at room temperature (22° C.) and preferably, the mixing is carried out under high shear, for example in a shear mixer at a shear rate of 100 $s^{-1}$. The mixture is not heated during this step although the temperature of the mixture may rise as a result of the applied shear. Preferably, the temperature does not rise above about 50° C.

Preferably, the matrix polymer solution comprises a solution of one or more polysaccharides in water, as described above. Preferably, the matrix polymer solution contains about 5 percent or less by weight of the polysaccharides. Particularly preferably, the matrix polymer solution contains between 3 percent and 5 percent by weight of the polysaccharides. Preferably, the matrix polymer solution additionally comprises about 1 percent or less by weight of a plasticiser, as described above. Particularly preferably, the matrix polymer solution comprises between about 0.1 percent and about 0.8 percent by weight of a plasticiser.

Preferably, the flavour composition and the matrix polymer solution are mixed to form a solution comprising between about 10 percent and about 30 percent by weight of the flavour composition, more preferably between about 15 percent and about 25 percent by weight of the flavour composition.

Preferably the emulsion is contacted with a cross-linking solution at a temperature of about 5° C. to about 15° C. Preferably, the cross-linking solution is a solution of approximately 5 percent by weight multivalent cations in water. Particularly preferably, the cross-linking solution is a calcium salt solution, for example, a calcium chloride solution. The emulsion is preferably left in contact with the cross-linking solution for between about 10 seconds and about 120 seconds, more preferably between about 40 seconds and about 80 seconds. The length of time may be selected depending on the desired degree of cross-linking and the desired hardness of the polymer matrix.

After cross-linking, the resultant flavour delivery material is removed from the cross-linking solution, for example, using a sieve or similar apparatus. The flavour delivery material is then preferably rinsed to remove the cross-linking solution from the surface and dried. Drying may be carried out using any suitable means, including for example a stream of hot air. The drying may optionally be carried out under vacuum.

Prior to being added to the cross-linking solution, the emulsion of the flavour composition and matrix polymer solution may be formed into a variety of shapes, depending upon the desired form of the flavour delivery material. For example, the emulsion may be formed into cylindrical or spherical shapes in order to produce threads, beads or droplets of the material. This may be carried out using a suitable extrusion or spheronisation technique. Alternatively, the emulsion may be formed into a sheet, cut into strips or flakes, or drawn into an elongate filament or yarn.

Figure 2:
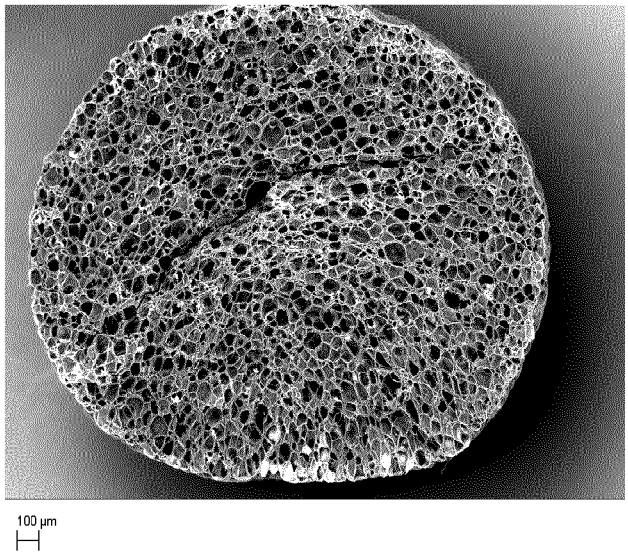

The invention will be further described, by way of example only, with reference to the accompanying drawings, in which:

FIG. 1 shows a side view of a filter cigarette according to the present invention comprising a flavour delivery material in the tobacco rod; and FIG. 2 shows a scanning electron microscope image of the flavour delivery material used in the filter cigarette of FIG. 1.

The cigarette 10 shown in FIG. 1 comprises an elongate, cylindrical wrapped tobacco rod 12 attached at one end to an axially aligned, elongate, cylindrical filter 14. The filter 14 includes a single segment of cellulose acetate tow. The wrapped tobacco rod 12 and the filter 14 are joined in a conventional manner by tipping paper 16, which circumscribes the entire length of the filter 14 and an adjacent portion of the wrapped tobacco rod 12. To mix ambient air with mainstream smoke produced during combustion of the wrapped tobacco rod 12, a plurality of annular perforations 18 are provided through the tipping paper 16 at a location along the filter 14.

A single flavour bead 20 formed of a sustained release flavour delivery material, as described above, is provided centrally within the filter 14. The flavour bead 20 has a diameter of around 2.5 mm. The flavour delivery material in the bead 20 incorporates a flavour composition comprising a menthol flavourant, which is released upon compression of the material with a force of between about 5 Newtons and about 10 Newtons. After compression, the menthol flavourant is available for release into the mainstream smoke as the smoke passes through the filter during smoking.

The amount of flavour composition released from the flavour delivery material depends upon the applied compressive force such that the flavour intensity can be controlled through control of the pressure applied to the filter. The flavour delivery material can be compressed one or more times prior to or during smoking in order to provide a burst of menthol flavour to the smoke.

An example of a suitable formulation for the flavour delivery material forming the bead and a process for forming the flavour delivery material is set out below.

EXAMPLE 1

The flavour delivery material comprises a cross-linked pectin-alginate matrix with a plurality of domains of a menthol flavour composition dispersed through the matrix. To produce the flavour delivery material, the menthol flavour composition is first formed from a mixture of the following components:

| Component | Amount (weight percent) |
|---|---|
| Natural L-menthol | 28 |
| MCT Oil (MYGLIOL 810) | 70 |
| Other flavour | 2 |

A matrix polymer solution is then formed from a mixture of the following components:

| Component | Amount (weight percent) |
|---|---|
| Sodium alginate (available from Sigma Aldrich) | 2.47 |
| Citrus Pectin (available from Sigma Aldrich) | 0.96 |
| Polyethylene glycol 1500S | 0.27 |
| Water | 96.30 |

A solution is formed with 20 percent w/w of the flavour composition and 80 percent w/w of the matrix polymer solution. The solution is mixed in a shear mixer, such as a Polytron 3100B equipped with a dispersing aggregate head PT-DA 3030/4 EC with a diameter of 30 mm, available from Kinematica. The solution is subjected to high shear at an RPM of 15000 to 20000 whilst maintaining the mixture at a temperature of 52-55° C. The mixing is continued for 3 to 4 minutes to produce an emulsion of the flavour composition in the matrix polymer solution in which the size of the flavour composition droplets is reduced to below about 20 to 40 microns.

The resultant emulsion is formed into the shape of spherical beads and dropped into a cross-linking solution of the following composition, at a temperature of 4° C.:

| Component | Amount (weight percent) |
|---|---|
| Calcium chloride (available from Sigma Aldrich) | 5.0 |
| Water | 95.0 |

The beads are left in the cross-linking solution for approximately 60 seconds in order to cross-link the alginate and pectin to form the polymer matrix. The beads are then removed from the cross-linking solution and washed in water before being dried in hot dried air at a temperature of 40-50° C. for 300 minutes.

FIG. 2 shows a scanning electron microscope image of the flavour delivery material produced in the above example. It can be seen from the image that the internal structure of the flavour delivery material is provided by a polymer matrix with a plurality of small domains of the flavour composition dispersed through the matrix.

The sustained release profile of the bead of flavour delivery material may be analysed in a flexure test. In the flexure test, a bead of flavour delivery material of a known weight is mounted on a base plate and compressed by a flat compression head having an area that is greater than the area of the bead. The compression head exerts a compressive force in a downwards direction onto the bead. During the flexure test, the compression head is brought into contact with the bead and moved downwards by a defined distance or force, referred to as the 'flexure' distance or force.

The force required to move the compression head by the defined flexure distance is measured. The percentage deformation of the bead at the flexure distance of the compression head corresponds to the flexure divided by the initial diameter of the bead, multiplied by 100 percent. After compression, the bead is removed from the compression apparatus and the amount of flavour composition that has been released from the flavour delivery material as a result of the applied compressive force is measured.

The amount of released flavour composition can be estimated as follows. After removal from the compression apparatus, the bead is wiped with tissue or another non-abrasive, absorbent paper material in order to remove as much of the flavour composition from the ruptured domains as possible. The bead is then weighed to determine the approximate weight of the flavour composition that has been released from the material as a result of the applied compression by comparing the measured weight with the original weight of the bead. For the present purposes, it is assumed that the measured weight loss from the bead corresponds to the amount of the flavour composition that is released.

A sequence of similar tests is then carried out with the compression head moved downwards by different defined flexure distances.

The measured deformation and percent weight loss from the beads at different compressive forces were found to vary as shown in the table below. For each flexure distance, the values indicate corresponds to the average mean values from identical tests carried out on 5 beads.

| Flexure (mm) | Force (N) | Deformation (%) | Weight loss (%) |
|---|---|---|---|
| 0.3 | 8.75 | 12 | 3 |
| 0.6 | 9.44 | 24 | 9 |
| 0.9 | 12.19 | 36 | 16 |
| 1.2 | 17.73 | 48 | 28 |
| 1.4 | 13.6 | 56 | 33 |

As can be seen from the results above, an increasing amount of flavour composition is released from the flavour delivery material at high compressive forces and higher levels of deformation. The results illustrate that the bead is capable of sustained release of the flavour composition over a range of compressive force of around 9 Newtons. The results additionally illustrate that the bead is capable of sustained released of the flavour composition over a range of deformation of around 30 percent.

In certain circumstances, it may be desired to measure the amount of flavour composition released from the same bead at two or more different compressive forces in order to determine the flavour release profile of a single bead. In that case, the flexure test described above is carried out on a bead with a first applied compressive force and after weighing of the bead to determine the loss of flavour composition, the same bead is tested again with a second compressive force. In both tests, the procedure as described above is followed, the only difference being that a single bead is used for both tests.

EXAMPLE 2

The flavour delivery material comprises a cross-linked alginate matrix with a plurality of domains of a menthol flavour composition dispersed through the matrix. The flavour delivery material is prepared using processes similar to those described above in Example 1.

The flavour composition is formed by dispersing menthol and flavour in a lipophilic phase made of a medium chain triglyceride (Miglyol 812N).

A hydrophilic polymer solution is then formed from alginate (Algogel 3001), corn starch (Merizet 100) and a plasticiser (polyethylene glycol (PEG) or glycerol), and mixed with the flavour composition to form an emulsion. The mixing is conducted in an Ultra-turrax apparatus operating at 10000 revolutions per minute and at a temperature of less than 30 degrees Celsius.

The emulsion is then added to a cross-linking solution comprising calcium chloride to form the polymer matrix having the plurality of domains. The emulsion is dripped into a bath of the cross-linking solution to form a flavour delivery material in the form of beads. The emulsion is added drop-by-drop through a nozzle using a peristaltic pump. The emulsion is dropped from a height of 30 centimeters through a 4.4 millimeter nozzle at a flow rate of 500 grams per hour. The process is carried out at room temperature and the bath of cross-linking solution is agitated using a magnetic mixer at a speed of 100 revolutions per minute. The emulsion and the cross-linking solution are allowed to react for a period of ten minutes.

Two batches of flavour delivery material were produced for this Example 2, the batches having the following compositions:

| Batch 1 | |
|---|---|
| Component | Amount (weight percent) |
| Algogel 3001 | 8.3 |
| Merizet 100 | 2.9 |
| Glycerol | 1.9 |
| Miglyol 812N | 60.7 |
| Menthol | 24.4 |
| Other flavour | 1.8 |

| Batch 2 | |
|---|---|
| Component | Amount (weight percent) |
| Algogel 3001 | 8.2 |
| Merizet 100 | 5.6 |
| PEG | 1.8 |
| Miglyol 812N | 57.8 |
| Menthol | 24.8 |
| Other flavour | 1.8 |

For batch 1, the number average weight of each bead of flavour material is 17.3 milligrams and the number average diameter of each bead is 3.4 millimeters. The average water content of each bead is 3.3% by weight and the average menthol content of each bead is approximately 4 milligrams.

For batch 2, the number average weight of each bead of flavour material is 16.3 milligrams and the number average diameter of each bead is 3.4 millimeters. The average water content of each bead is 4.0% by weight and the average menthol content of each bead is 3.2 milligrams.

A number of test cigarettes were formed by taking a plurality of standard cigarettes (circumference 25 millimeters, tipping length 32 millimeters, filter plug length 27 millimeters, tobacco rod length 57 millimeters, total length 84 millimeters) and removing the filter plug and the plug wrap from each cigarette, therefore leaving a hollow tipping paper tube attached to the tobacco rod. A new filter plug was cut to a length of 27 millimeters and the plug wrap removed. A slight incision was made in the filter plug using a scalpel and one bead of the flavour delivery material from either batch 1 or batch 2 was inserted into the filter plug such that the axial distance between the mouth end of the filter plug and the centre of the bead was 13.5 millimeters. A new filter plug, without a plug wrap, was then inserted into the hollow tipping paper tube of each cigarette to form the plurality of test cigarettes. For test cigarettes containing a bead from batch 1, the average resistance to draw of each test cigarette was 93 mmWG and the average ventilation of each test cigarette was 55%. For test cigarettes containing a bead from batch 2, the average resistance to draw of each test cigarette was 91 mmWG and the average ventilation of each test cigarette was 54%. Resistance to draw is measured using the test procedure described in ISO 6565:2002 and ventilation is measured using ISO 9512:2002.

A panel of five smoking experts conducted a qualitative test of the test cigarettes containing beads from batch 2. It was found that no minty note and no cooling sensation were perceived without compression of the beads. After several compressions a cooling, minty note was perceived by the panellists. The panellists noted that as more pressure was applied to the beads, the cooling sensation and minty notes increased.

The test cigarettes containing beads from batch 1 were tested to measure the "menthol in smoke" (MIS) when subjected to a smoking test after varying degrees of compression.

Firstly, the test cigarettes were grouped into sample sets each comprising 20 cigarettes. Each sample set was conditioned at 22 degrees Celsius and 60% relative humidity, and then each sample set was subjected to a compressive force applied simultaneously to the 20 cigarettes in each sample set. Each set was subjected to one of the following compressive forces: 0 Newtons; 700 Newtons per twenty cigarettes; 900 Newtons per 20 cigarettes; 1100 Newtons per 20 cigarettes; and 1300 Newtons per 20 cigarettes. The compressive force was applied using an Instron Instrument modified with a tool for compressing 20 cigarettes simultaneously. Two minutes after applying the compressive force, each sample set was smoked using a standard smoking test. Specifically, each smoking article was subjected to a standard smoking test under ISO conditions (35 ml puffs lasting 2 seconds each, every 60 seconds), with the ventilation zone fully uncovered. The total amount of menthol contained in the smoke from the cigarettes was measured and the test procedure repeated at each compressive force for a second set of 20 cigarettes. An average value for the amount of menthol contained in the smoke from each cigarette was calculated as follows:

| Compressive force (Newtons per 20 cigarettes) | Average menthol in smoke (milligrams per cigarette) |
|---|---|
| 0 | 0 |
| 700 | 0.34 |
| 900 | 0.405 |
| 1100 | 0.4 |
| 1300 | 0.425 |

As can be seen from the table above, with the matrix material used in these tests, the amount of menthol released does not vary linearly with the compressive force applied.

After the smoking tests were completed, the cigarette butts were cut open and the beads removed and weighed. As shown below, the greater the compressive force applied to each bead prior to the smoking test, the smaller the residual weight of the bead after the smoking test due to the release of menthol into the cigarette. A summary of the average residual weight of the beads after being subjected to compression and the smoking test is as follows:

| Compressive force (Newtons per 20 cigarettes) | Average residual weight of each bead after the smoking test (milligrams) |
|---|---|
| 0 | 17.16 |
| 700 | 11.61 |
| 900 | 10.54 |
| 1100 | 9.66 |
| 1300 | 9.02 |

The invention claimed is:

1. A smoking article incorporating a sustained-release liquid delivery material, the liquid delivery material comprising:

a closed matrix structure defining a plurality of closed pores; and a liquid composition that is trapped within the closed pores and is releasable from the closed matrix structure upon compression of the liquid delivery material, wherein the liquid delivery material provides a sustained release of the liquid composition upon compression of the liquid delivery material over at least a 5 Newton range of force.

2. A smoking article according to claim 1 wherein the liquid delivery material provides a sustained release of the liquid composition upon compression of the liquid delivery material over a range of force from 10 Newtons to 15 Newtons.

3. A smoking article according to claim 2 wherein an amount of the liquid composition released from the liquid delivery material upon compression of the liquid delivery material with a force of 5 Newtons corresponds to at least 2 percent by weight of the liquid delivery material prior to any compression and wherein an additional amount of the liquid composition that is released upon further compression of the liquid delivery material with a force of 10 Newtons to a total force of 15 Newtons corresponds to at least 10 percent by weight of the liquid delivery material prior to any compression.

4. A smoking article according to claim 2 wherein an amount of the liquid composition released from the liquid delivery material upon compression of the liquid delivery material with a force of 10 Newtons corresponds to at least 20 percent by weight of the liquid delivery material prior to any compression and wherein an additional amount of the liquid composition that is released upon further compression of the liquid delivery material with a force of 15 Newtons to a total force of 25 Newtons corresponds to at least 10 percent by weight of the liquid delivery material prior to any compression.

5. A smoking article according to claim 1 wherein an amount of the liquid composition released from the liquid delivery material upon compression of the liquid delivery material with a force of 5 Newtons corresponds to at least 2 percent by weight of the liquid delivery material prior to any compression and wherein an additional amount of the liquid composition that is released upon further compression of the liquid delivery material with a force of 10 Newtons to a total force of 15 Newtons corresponds to at least 10 percent by weight of the liquid delivery material prior to any compression.

6. A smoking article according to claim 5 wherein an amount of the liquid composition released from the liquid delivery material upon compression of the liquid delivery material with a force of 10 Newtons corresponds to at least 20 percent by weight of the liquid delivery material prior to any compression and wherein an additional amount of the liquid composition that is released upon further compression of the liquid delivery material with a force of 15 Newtons to a total force of 25 Newtons corresponds to at least 10 percent by weight of the liquid delivery material prior to any compression.

7. A smoking article according to claim 1 wherein an amount of the liquid composition released from the liquid delivery material upon compression of the liquid delivery material with a force of 10 Newtons corresponds to at least 20 percent by weight of the liquid delivery material prior to any compression and wherein an additional amount of the liquid composition that is released upon further compression of the liquid delivery material with a force of 15 Newtons to a total force of 25 Newtons corresponds to at least 10 percent by weight of the liquid delivery material prior to any compression.

8. A smoking article according to claim 1 wherein the liquid delivery material provides a sustained release of the liquid composition upon compression of the liquid delivery material over at least a 25 percent range of deformation.

9. A smoking article according to claim 1 wherein an amount of the liquid composition released from the liquid delivery material upon compression of the liquid delivery material to a 10 percent deformation corresponds to at least 2 percent by weight of the liquid delivery material prior to any compression and wherein an additional amount of the liquid composition that is released upon further compression of the liquid delivery material to a 40 percent deformation corresponds to at least 10 percent by weight of the liquid delivery material prior to any compression.

10. A smoking article according to claim 1, wherein the liquid delivery material comprises a sustained release flavour delivery material comprising a flavour composition.

11. A smoking article according to claim 1, wherein the liquid delivery material is a flavour delivery material, wherein the closed matrix structure is a polymer matrix comprising one or more matrix-forming polymers and a plasticiser, and wherein the liquid composition trapped within the plurality of closed pores defined by the polymer matrix is a flavour composition, the flavour composition comprising a flavourant mixed with one or more fats that are liquid at 22° C.

12. A smoking article according to claim 11 wherein the flavour composition of the flavour delivery material comprises a fat including at least 30 percent by weight of medium chain triglycerides having at least one carboxylic acid having a chain length of between 6 and 12.

13. A smoking article according to claim 12 wherein the plasticiser in the polymer matrix of the flavour delivery material comprises at least one of polyethylene glycol and glycerol.

14. A smoking article according to claim 11 wherein the plasticiser in the polymer matrix of the flavour delivery material comprises at least one of polyethylene glycol and glycerol.

15. A smoking article according to claim 14 wherein the amount of plasticiser in the polymer matrix corresponds to at least 5 percent by weight of the matrix-forming polymers.

16. A smoking article according to claim 11 wherein the amount of plasticiser in the polymer matrix corresponds to at least 5 percent by weight of the matrix-forming polymers.

17. A smoking article according to claim 11 wherein the matrix-forming polymers in the polymer matrix of the flavour delivery material include at least one of alginate and pectin.

18. A smoking article according to claim 1 wherein the liquid composition comprises menthol.

19. A smoking article according to claim 1 comprising a filter including the liquid delivery material.

20. The smoking article according to claim 1, wherein the closed matrix structure comprises a cross-linked polymer.

21. The smoking article according to claim 20, wherein the cross-linked polymer comprises a polysaccharide.

22. A filter for a smoking article comprising a sustained-release flavour delivery material, the flavour delivery material comprising:

a closed matrix structure defining a plurality of closed pores; and a flavour composition that is trapped within the closed pores and is releasable from the closed matrix structure upon compression of the flavour delivery material, wherein the flavour delivery material provides a sustained release of the flavour composition upon compression of the flavour delivery material over at least a 5 Newton range of force.

23. The filter for a smoking article according to claim 22, wherein the closed matrix structure comprises a cross-linked polymer.

24. The filter for a smoking article according to claim 23, wherein the cross-linked polymer comprises a polysaccharide.

* * * * *